United States Patent [19]

Schnelle et al.

[11] Patent Number: 4,589,642

[45] Date of Patent: May 20, 1986

[54] OPERATING TABLE

[75] Inventors: Eberhard Schnelle; Hans-Ulrich Jung; Rüdiger Mussler; Reinhard Pfeuffer, all of Rastatt, Fed. Rep. of Germany

[73] Assignee: Stierlen-Maquet AG, Rastatt, Fed. Rep. of Germany

[21] Appl. No.: 631,593

[22] Filed: Jul. 17, 1984

[30] Foreign Application Priority Data

Aug. 10, 1983 [DE] Fed. Rep. of Germany ..... 3328908

[51] Int. Cl.[4] ..... A61G 13/00

[52] U.S. Cl. ..... 269/325

[58] Field of Search ..... 91/520; 92/110; 269/323–326, 328; 108/3, 8–10

[56] References Cited

U.S. PATENT DOCUMENTS

| | | | |
|---|---|---|---|
| 3,206,188 | 9/1965 | Douglass | 269/325 |
| 3,609,974 | 10/1971 | Lado | 92/110 |
| 3,672,159 | 6/1972 | Sundin | 91/520 |
| 4,423,664 | 1/1984 | Buchl | 91/520 |

FOREIGN PATENT DOCUMENTS

| | | | |
|---|---|---|---|
| 308161 | 3/1933 | Italy | 269/325 |

*Primary Examiner*—Robert C. Watson

*Attorney, Agent, or Firm*—McCormick, Paulding & Huber

[57] ABSTRACT

An operating table includes a support surface with several support surface sections hydraulically adjustable relative to one another, a support column for the support surface with a column head (16) on which head the support surface is supported for pivotal movement and hydraulic adjustment and with a column foot (14) which is connected with the column head (16) through a hydraulic lifting apparatus (18), and a hydraulic unit (24) for operating the lifting apparatus and the work cylinders for adjusting the support surface sections. The hydraulic unit (24) is arranged on the column head (16). The lifting apparatus (18) includes two antiparallel lifting cylinders (26, 28) arranged next to one another and connected in parallel with one another having similar interior cross sections, the piston rod (30) of one cylinder being connected with the column head (16) and the piston rod (32) of the other cylinder being connected with the column foot (14). The pressure fluid supply and exhaust for the lifting apparatus (18) takes place through the piston rod (30) connected with the column head (16).

16 Claims, 12 Drawing Figures

FIG. 11
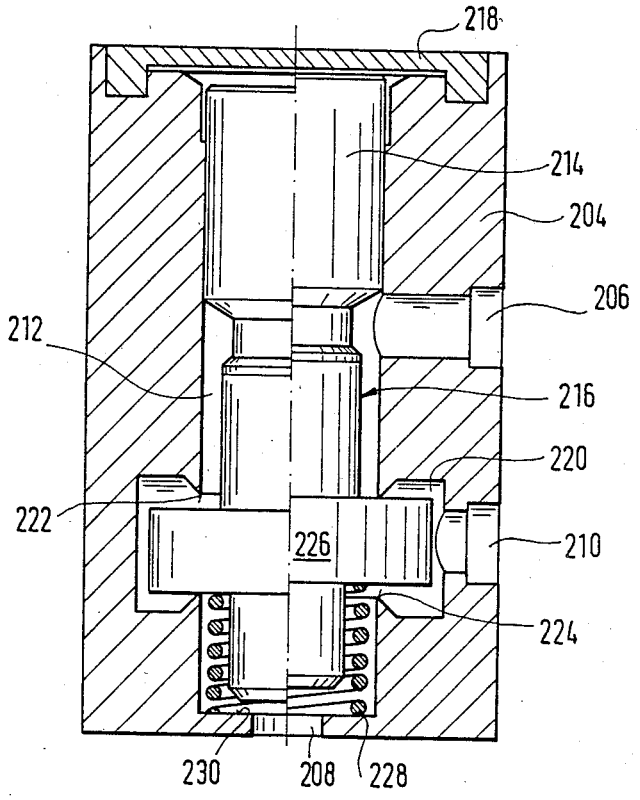
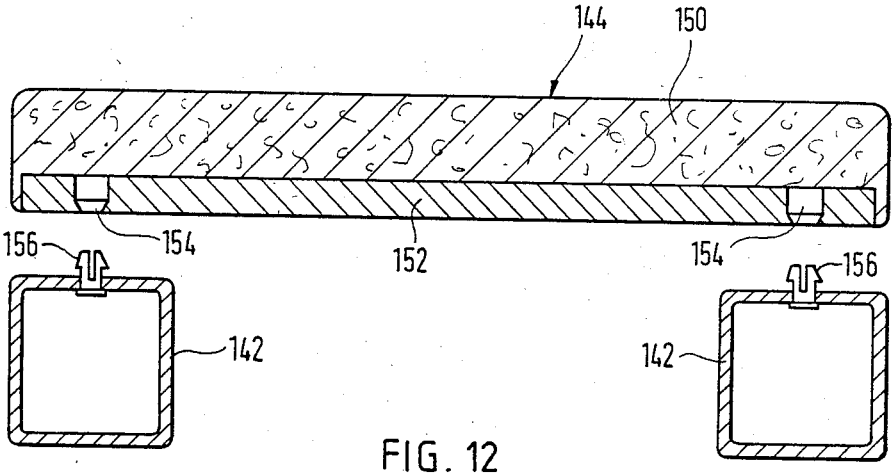
FIG. 12

OPERATING TABLE

The invention relates to an operating table including a support surface with several support surface sections adjustable relative to one another by means of hydraulic cylinders, a support column for the support surface with a column head, on which the support surface is adjustably mounted for movement about its longitudinal axis and/or its transverse axis by means of hydraulic cylinders, and a column foot connected to the column head through an hydraulic lifting apparatus, and an hydraulic unit for operating the cylinders and the lifting apparatus with an hydraulic pump, a pump motor, and a pressure fluid tank.

In the case of known operating tables of this type, it is customary to arrange the hydraulic unit in the column foot, which foot is either movable relative to the floor on rollers or is fixed in place to the floor. Flexible pressure fluid conductors are required for supplying the pressure fluid to the work cylinders connected to the support surface or to the height adjustable column head, which conductors generally are helically bent to permit up and down movement of the column head and of the support surface. Because of the relatively high pressure of the pressure fluid medium, these pressure fluid conductors are relatively thick walled and therefore quite stiff. They can be bent only along relatively large radii so that they require relatively large space in the column to allow free up and down movement of the column head. A larger column cross section, however, reduces the free space below the support surface and, for example, hinders the placement of an X-ray device under the support surface.

An object of the invention is to provide an operating table of the previously named type having as small a column cross section as possible.

This object is solved in accordance with the invention by having the hydraulic unit located on the column head. This has the advantage that all of the pressure fluid conductors between the hydraulic unit and the work cylinders located on the column head or on the support surface are fixed in length and need to be flexible only to a certain extent if necessary to permit a pivotal movement of the support surface relative to the column head. The pressure fluid conductors can therefore be packed closely and require only a small space. All pressure fluid conductors are removed from between the column head and the column foot. If the pump, for example, is driven by an electric motor, the electric connecting cable between the column foot and the hydraulic unit necessary for its supply, because of the flexibility of such cable, can be wound into a small helix so that the cable requires only a small space.

To permit adjustment in height of the support surface of a hydraulically powered operating table over the required range, the lifting apparatus usually includes a doubly telescoped work cylinder in which a first piston is slidably supported in one cylinder body and in this first piston, a second piston is coaxially slidable. In lifting of the support surface, the first piston is first extended to its stop and then the second piston is moved. With the supply of the same amount of pressure fluid per unit of time, in this case, the second piston is moved with a higher speed than the first piston, so that in the height adjustment of the support surface a definite speed jump appears which is unpleasant for the person lying on the operating table, and for height adjustments which may be necessary during an operation, may hinder the surgeon.

The invention therefore has as a further object, while obtaining of a large range of adjustment with small expense, to achieve a height adjustment for the support surface over its entire range of adjustment with constant speed.

With regard to this object and in accordance with the invention, the lifting apparatus includes two antiparallel lifting cylinders arranged next to one another with similar interior cross sections, with the piston rod of the first cylinder being connected with the column head and with the piston rod of the other cylinder being connected with the column foot and with the two cylinders being connected in parallel. Preferably, in this case, the pressure fluid inflow and outflow occurs through the piston rod connected to the column head so that the pressure fluid connection with the hydraulic unit is rigid, while the unit including the two actual cylinder bodies of the work cylinders moves with the extension and retraction of the two piston rods. A very compact construction is obtained in that the lifting cylinders for the lifting device are clamped between two blocks connected to one another by means of tie rods, in which tie rods connecting passages are formed for connecting the pressure fluid to the two cylinders so that the piston sided ends of both cylinders on one hand and the piston rod sided ends of both cylinders on the other hand are connected to one another by pressure fluid conductors connecting the blocks. Upon extension of the piston rods, the pressure fluid first flows through the piston rod connected with the column head into the piston sided cylinder space lying therebelow of this cylinder and from there, through the previously mentioned pressure fluid conductor to the upwardly lying piston sided cylinder space of the other lifting cylinder, while the pressure fluid expelled from the annular space flows from the lower end of the second lifting cylinder over the second pressure fluid conductor to the upper end of the annular space of the first cylinder and through a radial passage in the piston of the first cylinder and a second conductor in the piston rod of the first cylinder back to the hydraulic unit. Because of the similar interior cross section of the two lifting cylinders, an absolutely similar movement of the support surface during height adjustment is guaranteed over the entire range of adjustment. Because of the supply and exhaust of the pressure fluid through the piston rod of the first lifting cylinder and the previously described pressure fluid connection between the two cylinders, no flexible pressure fluid conductors are required.

A simple to manufacture, stable, and compact guide for the support surface of the operating table is obtained by a guide apparatus including a first guide rod connected with the column head and a second vertical guide rod arranged parallel to the first and connected with the column foot, each of which is nonrotatably slidable in one of two guides formed parallel to one another in a guide block so that the guide block can be coupled to the lifting cylinder of the lift apparatus for movement in a vertical direction.

Preferably, the guide rods have a rectangular cross section so that nonrotatability of the guide rods relative to the guide block is assured. The guide block can be made in a simple way by using a U-profile with rectangular cross section which U-profile has a separating wall parallel to the arms of the U dividing it into two guide chambers for the guide rods, and by a cover plate arranged parallel to the base of the U which closes the guide chambers. The rectangular cross section of the guide rods makes possible, in the case of large tolerances, a simple way for exactly adjusting the play of the guide rods in the guide chambers. As to this, in accordance with the invention, both sides of the separating wall are formed with wedge surfaces which cooperate with wedges adjustable parallel to the separating wall for adjusting the play of the guide rods. A simple pressure plate serves for adjusting the play of the rods in the second direction, which pressure plate, as well as the wedges, are adjustable by means of adjusting screws arranged in the guide block.

Operating tables should have the possibility of controlling all of the work cylinders of the table from a given distance so that this task can be carried out by a person not located directly in the sterile operating area. The control of the valves of the work cylinders of previously known operating tables is effected directly by hand, pneumatically, or electrically with solenoid valves. In the case of electric control, additional expense is required to meet safety requirements. Also, solenoid valves require relatively much space. A pneumatic control requires separate air pressure equipment and consumes a relatively large amount of energy. Manual control requires relatively strong conductors and large valves so that because of the weight of the control conductors and of an operating panel, they are arranged on an arm connected with the column. This has the disadvantage that the freedom of movement of the surgeon is hindered by the arm projecting into the sterile operating area.

To avoid these disadvantages, in accordance with the invention, the hydraulic unit has a high pressure circuit for operating the work cylinders as well as the lifting apparatus and also has a low pressure circuit for control purposes which connects the work cylinders with the hydraulic pump or the pressure fluid tank. The low pressure circuit can branch from the high pressure circuit of the hydraulic unit and makes possible the use of a portable hand register containing all of the control valves and connected with the valves of the work cylinders through flexible control conductors. Preferably, the control valves each include a control piston slidably arranged in the bore of a valve housing, which bore is closed by a flexible membrane, and which is movable from a closed position against a biasing force to an open position. This control piston can be moved by a direct pressure on its flexible membrane from its closed position to its open position. For safety reasons, the biasing force must be chosen to be relatively high in order to assure a return movement of the control piston to its closed position as soon as the membrane is released. A high biasing force, however, means that the operating person must press the membrane with a relatively high force for a relatively long time. To facilitate the holding of the control piston in the open position in accordance with the invention, the control valve is so made that in the open position the effective piston surface exposed to the control pressure is larger than the effective piston surface exposed to the control pressure when the valve is closed, with the surface difference being so chosen that the effective force resulting from the control pressure and tending to open the valve is smaller than the biasing force. Therefore, upon the opening of the valve, the full biasing force must indeed be overcome, yet when the control piston reaches the open position, only a relatively small holding force is required.

In the case of known operating tables, the support surface generally includes a middle section connected to the column head through a linkage enabling a pivotal movement of the middle section about a horizontal axis parallel to the support surface longitudinal direction and about an axis transverse to the support surface longtudinal direction and parallel to the support surface with each support surface section having two side rails which are pivotally connected to the side rails of the neighboring support surface section for movement about axes transverse to the support surface longitudinal direction and which are adjustable by means of double acting work cylinders. Generally, the side rails of a support surface section are rigidly connected by a cross rail. This cross rail has however the disadvantage that it hinders the use of an X-ray device. To avoid these disadvantages, in accordance with the invention, the side rails of each support surface section are mechanically independent of one another and the work cylinders associated with the two side rails of each support surface section are connected in series so that the annular space surrounding the piston rod of one work cylinder is connected with the piston sided space of the other cylinder with the cross sectional surfaces of the annular space of the one work cylinder and the piston sided space of the other work cylinder being of equal size. Thereby, a similar operation of the two cylinders is achieved which moves the two rails of a support surface section so that the mechanically rigid connection between the two side rails of a support surface section can be omitted. Therefore, the space between the two side rails is entirely free for the use of an X-ray device. An entirely similar adjustment of the side rails of a support surface section is naturally produced, since the two pistons of the work cylinders have exactly the same positions. Despite initially exact displacement of the two pistons, it can happen, for example, during a repair of the hydraulic system that the pistons take on different positions from one another. In order to compensate for this, it is convenient if a valve is arranged in the conductor which connects the annular space of the first cylinder with the piston sided space of the other cylinder. In the case of an operating table, on the grounds of cleanliness, an opening of the hydraulic circuit at some place during normal operation should be avoided. Also to enable bleeding air from the previously described conductors without opening the hydraulic circuit, in accordance with the invention, the air bleed port of the air bleed valve is connected through a pressure limiting valve to the pressure fluid tank. If also, for example, the fluid column between the two pistons of the two series connected cylinders is too large, excess pressure fluid can be exhausted through the pressure limiting valve to the pressure fluid tank by opening the bleed valve and applying work pressure to the pistons. In the reverse case, that is, in the case of a too little fluid column between the two pistons in order to fill the space with pressure fluid, the bleed port of the bleed valve is connected to the high pressure circuit through a pressure regulating valve so that the pressure applied to the pressure regulating valve is lower than the pressure applied to the pressure limiting valve. In this way, it is possible, for example, to completely extend the first piston and in this position, fill both pistons through the pressure regulating valve from the high pressure circuit without the pressure fluid being able to flow back through the pressure limiting valve to the pressure fluid tank.

Customarily, the side rails of each support surface section carry a support plate which is screwed to them onto which a cushion is laid or buttoned. During an operation, liquid (for example, blood) in which liquid germs dangerous to health can multiply can enter between the cushion and the mat. Therefore, after each operation, the cushion must be removed and the support plate must be cleaned and disinfected. In accordance with the invention, the cushion includes a plate unreleasably connected with it which is connectable to the side rails by means of releasable snap means. The cushion can in this case be removed in common with the plate from the side rails and cleaned without problem. Preferably, the plate is embedded in the cushion which is made of foam material, it being foamed in place during the foaming of the cushion.

Further features and advantages of the invention will be apparent from the following description which in combination with the accompanying drawings explain an embodiment of the invention. The drawings are:

FIG. 11 is an enlarged section through a control valve and taken on a plane containing the axis of its control piston.

FIG. 12 is a schematic section through a support surface section taken along the line XII—XII of FIG. 1.

DESCRIPTION OF THE PREFERRED EMBODIMENT

Figure 1:
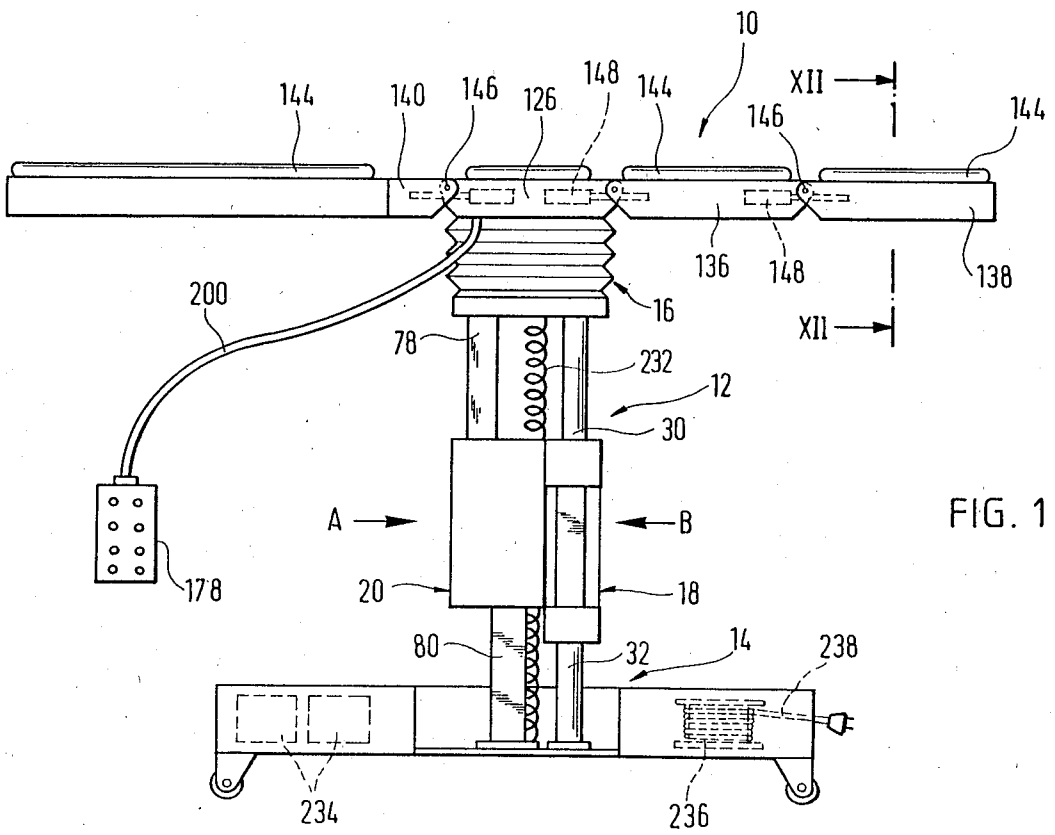
FIG. 1 is a schematic side view of an operating table embodying the invention with the column being shown partially open.

FIG. 1 shows schematically an operating table with a support surface 10, which rests on a column indicated generally by the reference numeral 12. The column 12 includes a foot 14 and a head 16 which are connected to one another by means of a lifting mechanism 18 and a guide apparatus 20.

The column head 16 includes a rectangular base plate 22 to the underside of which is fastened a hydraulic unit 24 in a closed rectangular housing, the construction of which is explained in detail hereinafter.

Figure 3:
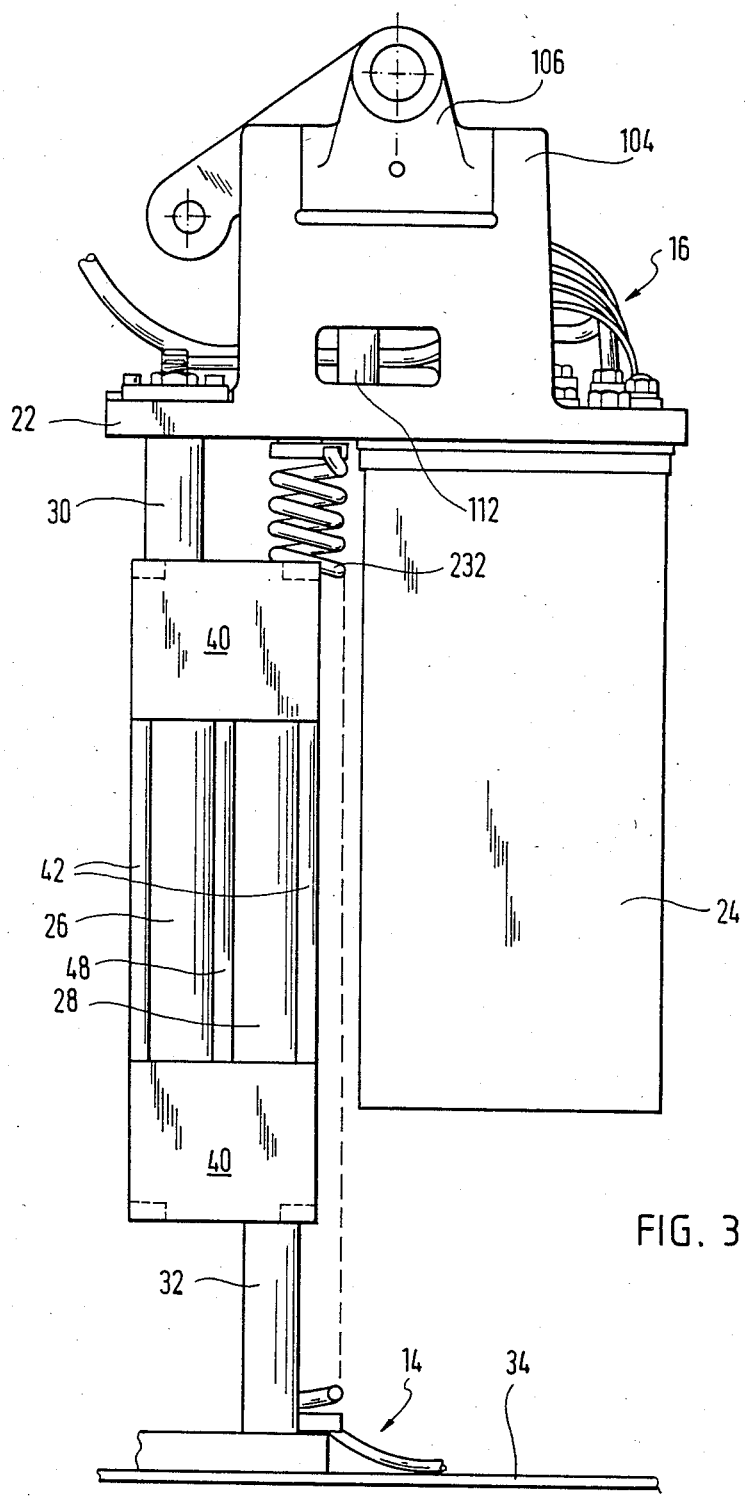
FIG. 3 is an enlarged fragmentary view of the column taken in the direction of the arrow B of FIG. 1.
Figure 7:
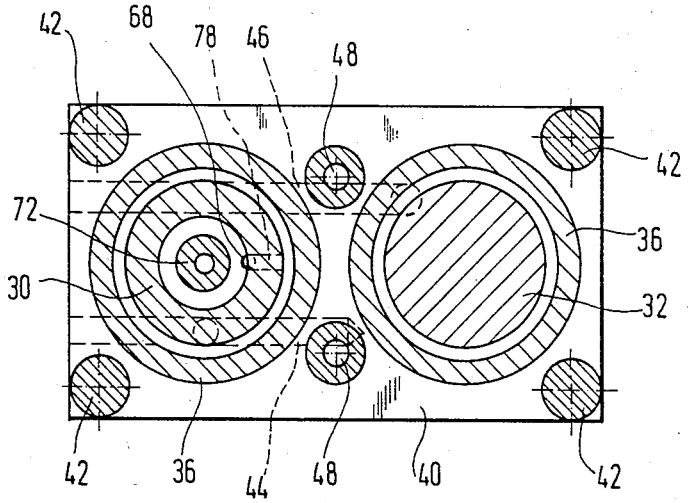
FIG. 7 is a horizontal section through the apparatus of FIG. 6 taken along the line VII—VII of FIG. 6.
Figure 6:
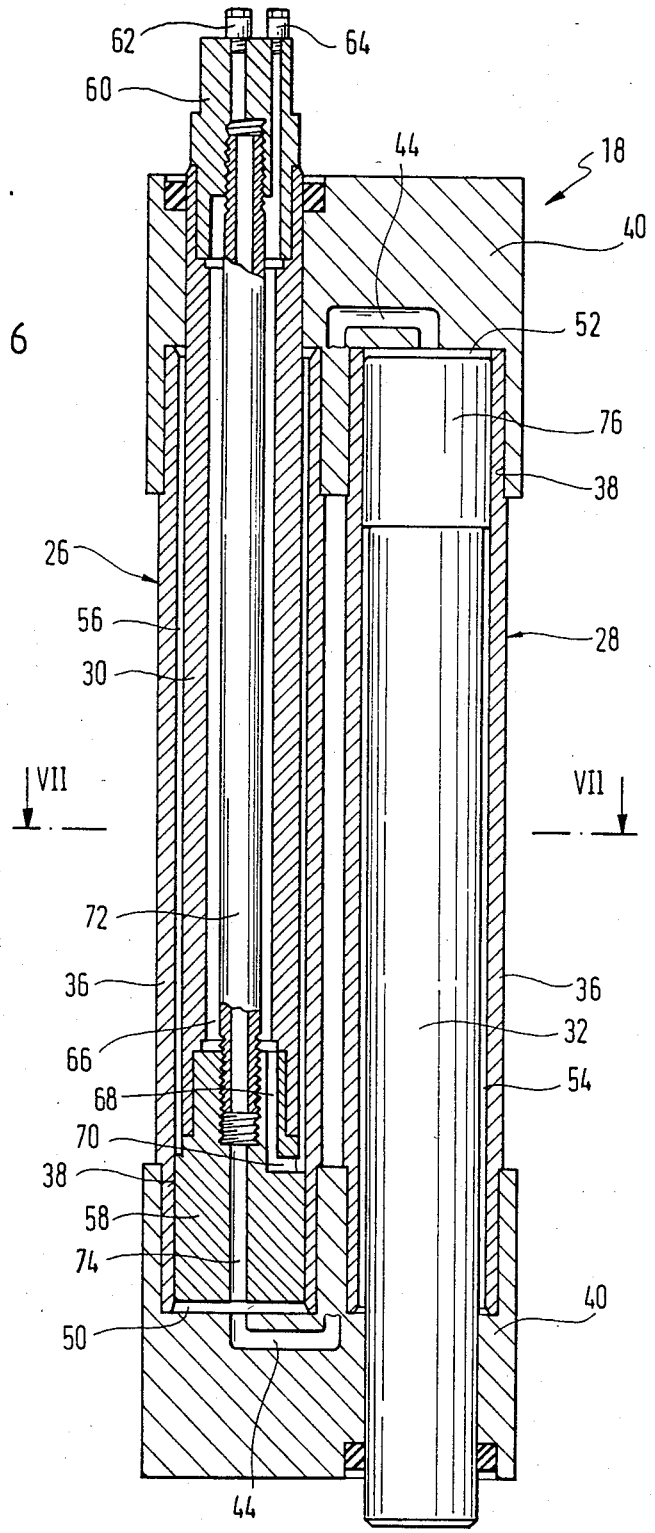
FIG. 6 is a sectional view taken on a plane containing the cylinder axes of the work cylinder of the lifting device.

The construction of the lifting apparatus 18 will now be described more closely in connection with FIGS. 3, 6, and 7. This lifting mechanism 18 includes two actuating cylinders 26 and 28 arranged antiparallel to one another with the piston rod 30 of the cylinder 26 being rigidly connected with the base plate 22 of the column head 16 and with the piston rod 32 of the cylinder 28 being rigidly connected with a base plate 34 of the column foot 14.

The cylinder bodies 36 of the cylinders 26 and 28, which bodies are open at both ends, are inserted in bores 38 of blocks 40, and the two blocks 40 are rigidly connected to one another with the help of tie rods 42 so that the cylinder bodies 36 are clamped between the two blocks 40. The two blocks 40 are of similar formation and contain connecting passages 44 and 46 which connect the receiving bores 38 for the ends of the cylinder bodies 36 with a pressure fluid conductor 48 connecting the two blocks 40. Contrary to the representation in FIG. 6, these connecting passages 44 and 46 do not lie in the plane containing the cylinder axis but instead on either side of the same as seen in FIG. 7. The arrangement of the connecting passages 44 and 46, as well as of the connecting conductor 48 between the blocks 40, is such that the lower end of the cylinder 26, that is, its piston sided cylinder space 50, is connected with the upper end, that is, again the piston sided cylinder space 52, of the cylinder 28, while the lower end of the annular space 54 of the cylinder 28 is connected with the upper end of the annular space 56 of the cylinder 26.

The piston rod 30 of the cylinder 26 is made from a tube which at its lower end is closed by the piston 58 and at its upper end is closed by a plug 60, on which are two pressure fluid connectors 62 and 64. The connector 64 connects with the inner space 66 of the tubular piston rod 30 with this inner space 66 on its own part being connected with the annular space 56 of the cylinder 26 by means of a passage 68 parallel to the axis and a radial passage 70 in the piston 58.

A further tube 72 is arranged in the inner space 66 of the piston rod 30 which tube is screwed at its upper end into the plug 60 and is connected with the pressure fluid connector 62, while its lower end is screwed into the piston 58 and is connected with the piston sided cylinder space 50 through an axial passage 74 in the piston 58.

If the piston rods 30 and 32 are to be extended, pressure fluid flows through the pressure fluid connector 62, the tube 72, the passage 74 in the piston 58 to the piston sided cylinder space 50 of the cylinder 26 and urges the piston 58 upwardly. At the same time, the pressure fluid flows through the connecting conductors 44 and 48 to the upper block 40 and there through the corresponding connecting passage 44 into the piston sided cylinder space 52 of the cylinder 28 and urges the piston 76 of the cylinder 28 downwardly. The pressure fluid thereby displaced from the annular space 54 flows through the connecting passage 46 and the pressure fluid conductor 48 to the upper end of the annular space 56 of the cylinder 26 and from there through the passages 70 and 68 in the piston 58 into the inner space 66 of the piston rod 30 and from there through the pressure fluid connector 64 back to the hydraulic unit 24. During retraction of the piston rods 30 and 32, the pressure fluid flow occurs in the reverse direction. In practice, the piston 58 first moves to its upper stop before the piston 76 moves. Since the pistons have similar cross sections, the piston rods 30 and 32 are extended at the same speed so that no speed shift occurs when the second piston starts moving. As will be recognized, the pressure fluid connectors 62 and 64 are fixed relative to the column 16 so that during the extension and retraction of the piston rods 30 and 32, the connecting conductors between the lift mechanism 18 and the hydraulic unit 24 are not moved.

Figure 4:
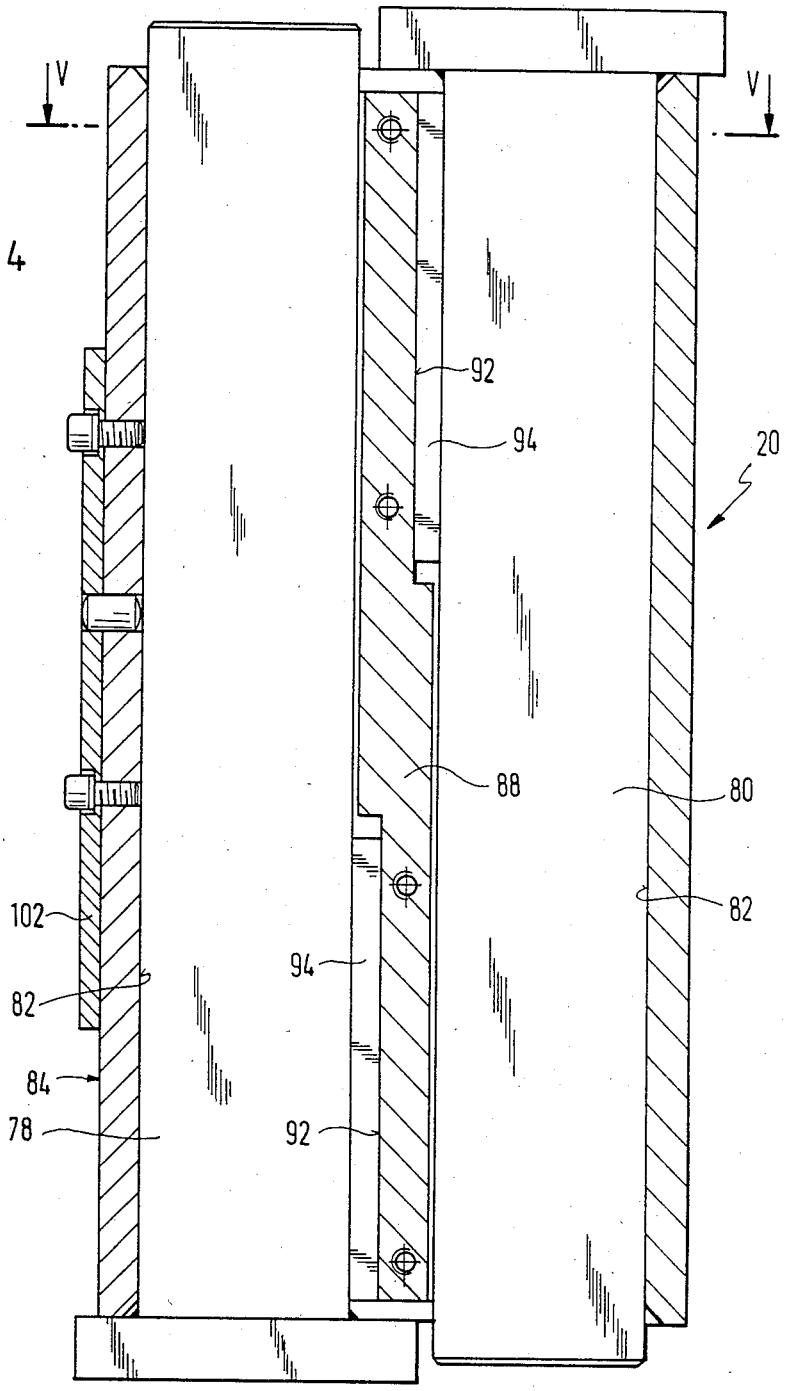
FIG. 4 is a vertical section through the vertical guide apparatus taken along the line IV—IV of FIG. 5.

The guide apparatus 20 in the height adjustable column 12 serves to conduct the horizontal forces working on the support surface 10 and a movement applied to the support surface 10 to the column foot 14, which guide apparatus will now be explained in more detail with reference to FIGS. 4 and 5. The guide apparatus 20 includes a first guide rod 78 which is rigidly connected with the base plate 22 of the column head 16, as well as a second guide rod 80 rigidly connected with the base plate 34 of the column foot 14. Both the guide rods 78 and 80 have a rectangular cross section and are supported for sliding movement parallel to one another in two guide chambers 82 of a guide block 84. The guide block 84 consists of a U-profiled rail 86 having a rectangular cross section whose inner space is divided by a separating wall 88 extending parallel to the arms of the U, which separating wall 88 divides the inner space into the two guide chambers 82. The U-profiled rail 86 is closed by a cover plate 90 connected to it by means of screws.

Figure 5:
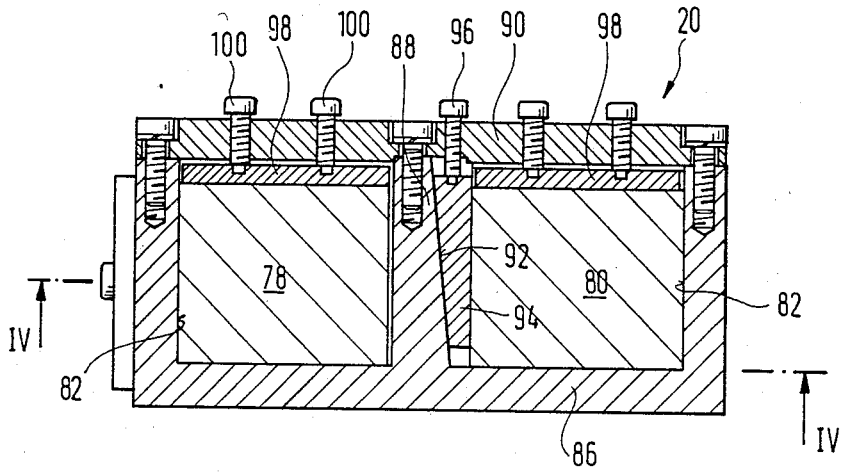
FIG. 5 is a horizontal sectional view through the vertical guide apparatus taken along the line V—V of FIG. 4.

To adjust the play of the guide rods 78 and 80 in the guide chambers 82, the separating wall 88 has a wedge face 92 on both sides which cooperates with a wedge 92 which is slidably movable by means of an adjustment screw 96 operable through the cover plate 90; and in this manner, the play of the guide rods 78 and 80 can be changed in a direction perpendicular to the separating wall 88, as will be especially apparent from FIG. 5. To adjust the play parallel to the separating wall 88, an adjustment plate 98 is arranged on the inner side of the cover plate 90, which adjustment plate 98 can be adjusted perpendicular to the cover plate 90 by means of screws 100 passing through the cover plate 90. The adjustment plates 98 and the wedges 92 offer the possibility of assuring a perfect guiding of the guide rods 78 and 80 in the guide block 82 even when the guide rods and guide block are made with relatively large tolerances.

On the outer side of the guide block 84 facing the lifting device 18 is fastened a plate 102 which intervenes in the space between the blocks 40 of the lifting device 18 without the lifting device and the guide apparatus being connected with one another. Therefore, upon a lifting of the cylinder blocks of the lifting device 80, the guide block 84 is taken along.

The support surface 10 is so supported in a known manner on the column head 16 that it can be inclined about an axis extending transversely to its longitudinal direction and can be tilted about an axis running parallel to its longitudinal directon. For this purpose, a first frame 106 is pivotally supported from a support block 104 rigidly connected with the base plate 22 of the column head 16 for movement about a inclining axis 108 arranged perpendicular to the longitudinal direction of the support surface. The first frame 106 has a fork 110 connected with the piston rod 112 of an inclining cylinder 114. The inclining cylinder 114 is pivotally supported below the base plate 22 of the column 16 by two struts 116 with the piston rod 112 extending through a non-illustrated opening in the base plate 22. The inclining cylinder 114 is connected with the hydraulic unit 24 by means of pressure fluid conductors of which only one such conductor 118 is illustrated.

Figure 2:
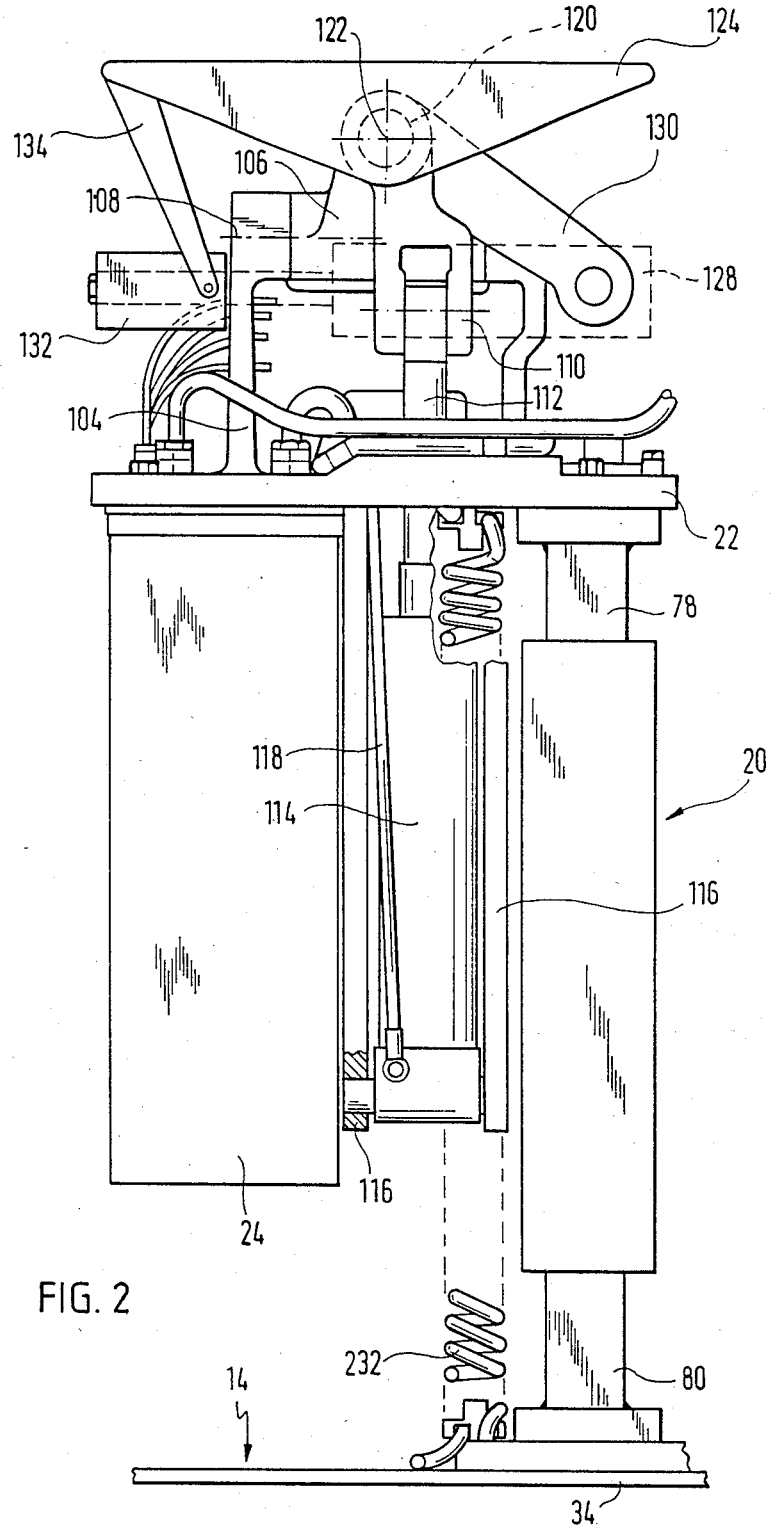
FIG. 2 is an enlarged fragmentary view of the column in the direction of the arrow A of FIG. 1.

A second frame 124 is pivotally supported in a bearing sleeve 120 of the first frame 106 for movement about a tilt axis 122 perpendicular to the inclining axis and parallel to the longitudinal direction of the support surface, with which second frame 122 a middle section 126 of the support surface 10 is rigidly connected. A second frame 124 is adjustable with the help of a hydraulic cylinder 128 which at one point is pivotally connected with the fork 130 connected to the frame 106 and which is connected with its piston rod to a U-shaped stirrup 132 connected to the second frame 124 through connecting struts 134. The pressure fluid conductors of the adjusting cylinder 128 for connecting to the hydraulic unit 124 are not illustrated in FIGS. 2 and 3.

The support surface 10 in addition to the already mentioned middle section 126 rigidly connected with the second frame 124 consists of two back sections 136 and 138 (FIG. 1) as well as a leg section 140 connected to the other side of the middle section 126. Each support surface section consists of two side rails 142 (see FIG. 12), which can be made from U-profile members or box-profile members and on which a support cushion 144 is arranged. The adjacent side rails 142 on each side of the support surface 10 are connected in a known way for pivotal movement about an axis 146 extending transversely to the longitudinal direction of the support surface and moreover the neighboring side rails are adjustable by means of a cylinder 128 which has its cylinder connected to one side rail and its piston rod connected to the neighboring one. The so far described construction of the support surface 10 is in itself known. In such known support surface the side rails 142 are rigidly connected to one another by means of a cross rail. These cross rails are not included in the support surface according to the invention. To be able to omit the cross rails an absolutely similar operation of the cylinders 148 which adjusts the side rails 142 of the same support surface section has to be guaranteed. How this similar operation of the cylinders associated with each support surface section is achieved is explained in greater detail below in connection with FIG. 9.

FIG. 12 shows the connection of a support cushion 144 with two side rails 142. The cushion 144 consists of a foamed material layer 150 into which is embedded a rigid plate 152 forming the lower side of the cushion. This plate 152 has undercut cam openings 154 into which cam heads 156 connected to the side rails 142 can be snapped. The support cushion 144 can therefore be removed or connected relative to the side rails 142 without the help of work tools. This eases the cleaning of the support cushion 144.

The construction of the hydraulic unit 24 and the control of the different hydraulic cylinders will now be explained with reference to FIGS. 8 to 10.

Figure 8:
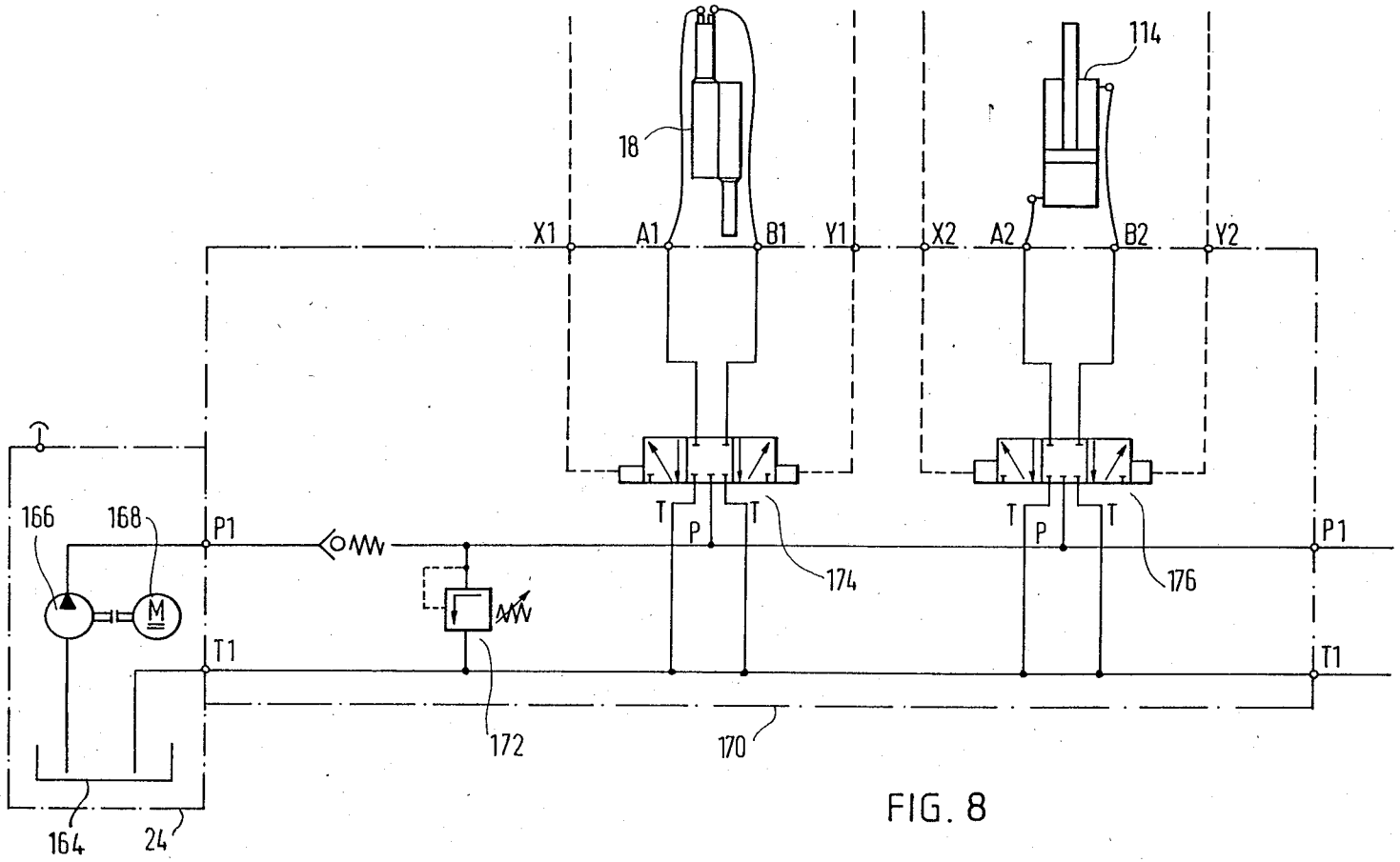
FIG. 8 is a schematic illustration of the hydraulic unit and its connection with the work cylinders for raising and lowering the support surface and for moving the support surface about an axis perpendicular to its longitunidal direction.

According to FIG. 8, the hydraulic unit 24 includes a pressure fluid tanks 164 and a pump 166 driven by an electric motor 168. The pump produces at its output a pressure P1. The return flow line to the pressure fluid tank 164 is designated T1.

Directly connected to the hydraulic unit 24 is a first control valve block 170 containing a pressure limiting valve 172 which adjusts the pressure P1 created by the pump in the illustrated case to 100 bar. This is the working pressure for operating the cylinders used with the operating table. The control block 70 further includes the operating valves 174 and 176 for the cylinders of the lifting device 18 and the inclining cylinder 114 respectively. The positions of the valves and therefore the connections of the lifting apparatus 18 and the inclining cylinder 114 are directly apparent from the usual hydraulic symbols. The valves 174 and 176 are operated from a control register 178 illustrated in FIG. 10 over control lines X1, Y1 and X2, Y2 respectively, which control register is explained in greater detail hereinafter.

A second control block 180 is connected to the first control block 18 with the input of the second control block having the pressure P1 applied to it. The control block 180 contains first of all the operating valves 182, 184, 186, and 188 for the cylinders 128 for tilting the support surface 10 as well as the adjusting cylinders 148 for the leg section 140, the first back section 136 and the second back section 138 of the support surface 10. The valves 182 to 188 are controlled from the control register 178 over control lines X3, Y3, X4, Y4, X5, Y6, and X6, Y6. They connect selectively the piston sided cylinder space and the annular space of their associated cylinders to the pressure line containing the work pressure of 100 bar or to the return line to the pressure fluid tank 164, as can be understood from the usual hydraulic symbols.

Figure 9:
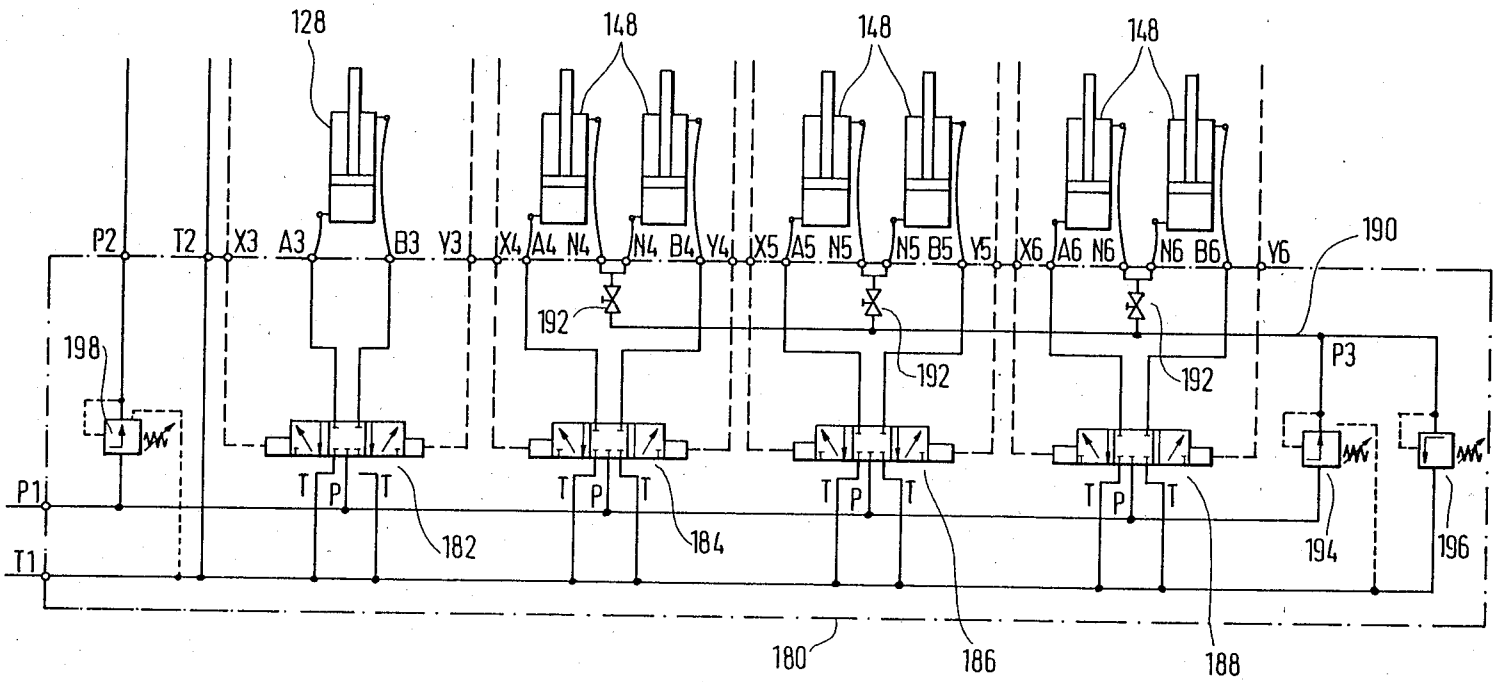
FIG. 9 is a schematic illustration of the connection of the hydraulic unit with the work cylinders for adjusting the support surface sections and for tilting the support surface about its longitudinal axis.
Figure 10:
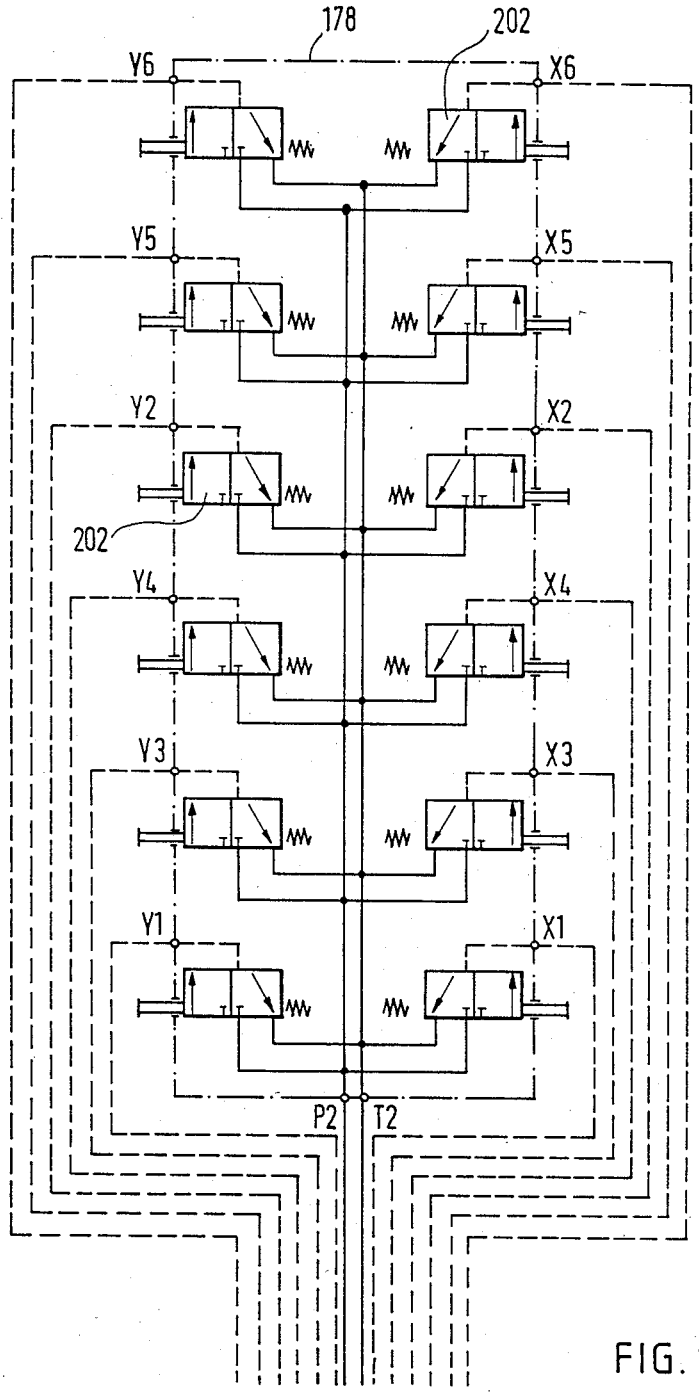
FIG. 10 is a switching diagram for the control valves included in the hand register.

As shown in FIG. 9, the adjusting cylinders 148 for the individual sections of the support surface 10 are connected in series so that the annular space of the first cylinder 148 is connected to the piston sided cylinder space of the next cylinder 148 over the pressure fluid line 190. The cross sectional measurement of the two cylinders connected in series for each supporting surface section are so chosen that the cross sectional area of the ring space of the first cylinder is similar to the cross sectional surface of the piston sided cylinder space of the series connected second cylinder so that upon an application of fluid to the cylinders 148 of one support surface section, the pistons of both cylinders will be moved a similar amount.

To permit the two pistons of a cylinder pair to be brought to a similar output position, a valve 192 is connected to the pressure fluid line 190, which on the one hand is connected with the pressure side of the pump 166 through a pressure regulating valve 194 and on the other hand is connected with the pressure fluid tank 164 through a pressure limiting valve 196. The pressure at the pressure regulating valve is adjusted to be below the working pressure value and in the present case is, for example, 30 bar. The limit pressure of the pressure limiting valve is adjusted to be between the working pressure and the pressure of the pressure regulating valve 194, in the present case, for example, 40 bar. To bring the two pistons of a cylinder pair to the same position, the following procedure is followed in which case the cylinder pair associated with the leg section 140 will be assumed to be the ones in question.

First of all, the two cylinders 148 of the pair are supplied with pressure fluid through the connector A4 or B4 until one of the pistons reaches its end position. If the pressure fluid column between the two pistons is too large, the downstream or second piston—with respect to the direction of flow of the pressure fluid—first reaches its end position while the first piston does not reach its position. In this case, after the valve 192 is opened, the first piston is further supplied with pressure fluid in which case the excess pressure fluid from the fluid column between the two pistons can flow out through the pressure limiting valve 196 to the pressure fluid tank 164 until the first piston reaches its end position. Now the two pistons are in similar base positions. The valve 192 is closed and upon a subsequent actuation of the cylinder pairs, a similar operation of the two pistons is assured. For the case in which the pressure fluid column in the two pistons of a cylinder pair is too small, the first piston—in the flow direction of the pressure fluid—reaches its position first, while the downstream piston cannot reach its end position. In this case, upon the opening of the valve 184, the valve 192 is again opened, so that now pressure fluid can enter the conductor 190 through the pressure regulating valve 194 and can move the downstream piston to its end position, so that again both pistons of the cylinder pair have similar basic positions. Since the limit pressure of the pressure limiting valve 196 lies above that of the pressure regulating 194, no pressure fluid can flow to the tank through the pressure limiting valve 196.

The preceding method has the advantage that the adjustment of the similar operation of the pistons of a similar pair can be done through the hydraulic system itself without the system having to be opened at some place. This is of great importance in respect to the cleanliness of the operating table. The hydraulic system remains constantly closed. The preceding method can be repeated at any time.

The control of the operating valves 174, 176 and 182 to 188 is also performed hydraulically in a low pressure circuit branching from the high pressure circuit using the working pressure through a pressure regulating valve 198 in the second control block 180. In the illustrated example, the pressure of 12 bar is used for the control circuit. Because of this low control pressure, the control register 178, made as a portable hand register, can be connected through thin control conductors X1 to X6 and Y1 to Y6 with the operating valves 174, 176 and 182 to 188, which thin control conductors may be collected together into a flexible cord 200 (FIG. 1), so that the operating table can be controlled from any desired position, limited only by the length of the cord 200.

The control register 178 contains control valve pairs corresponding in number to the number of operating valves with each control valve of a pair controlling one work direction of the associated double-acting hydraulic cylinder.

FIG. 11 illustrates more closely the construction of one control valve 202. It includes a housing 204 with one port 206 for the low pressure conductor (P2 in FIG. 10), a port 208 for the conductor to the pressure fluid tank 164 (P2 in FIG. 10), and a control port 210 for the associated control conductor. The ports 206 to 210 are connectable to one another through a central bore 212 in the housing 204. The shaft portion 212 of a control piston 216 is slidably guided in the bore 212 and the end of the bore opposite from the port 208 is tightly closed by a flexible membrane 218.

In the vicinity of the control port 210, the central bore 212 widens to form a chamber 220 bounded by two annular valve seats 220 and 224, which in turn are capable of being tightly closed by the actual piston portion 226 of the control piston 216. The control piston 216 is urged in the direction toward the flexible membrane 218, therefore in the direction toward the valve seat 222, by a helical spring 228. The helical spring 228 at one end engages the piston section 226 of the control piston 216 and at its other end engages a shoulder 230 of the valve housing in the vicinity of the port 208. By pressing on the flexible membrane 218, the control piston 216 can be shifted between the two valve seats 222 and 224.

In its rest position, the control piston 216 rests on the valve seat 222 and thereby closes the connection between the pressure port 206 and the control port 210. In the section lying between the two ports 206 and 210, the shaft portion of the control piston 210 has a smaller diameter than that of the wall of the bore 212, and the hydraulically effective surfaces are of equal size so that the applied pressure cannot move the control piston in either direction. This position of the control piston 216 is illustrated in the right half of FIG. 11.

If the control piston 216 is now moved against the force of the spring 208 in the direction toward the valve seat 224 by pressing on the flexible membrane 218 until the piston section 226 reaches the valve seat 224, the pressure port 206 and the control port 210 come into connection with one another. This position is illustrated in the left half of FIG. 11.

For safety's sake, the biasing force of the spring 228 must be chosen to be relatively high in order to assure a definite return movement of the control piston 216 to its righthand position of FIG. 11. To avoid a tiring of the operating person through a long pressing down of the control piston 216 in the illustrated construction of the control valve 202, the force required to hold the control piston 216 in its lower position is diminished, by means of an hydraulic servo-effect, with respect to that initially required to overcome the biasing force of the spring 228. The difference between the initially required operating force and the holding force results from the fact that the valve seat 224 has a larger diameter than that of the valve seat 222. Therefore, the instant the piston section 226 seats on the valve seat 224, a difference between the effective piston area on the upper side and the effective piston surface on the under side of the piston section 226 comes into play. Because of the force produced by this surface area difference, the holding force is lower than that force which must first be applied to move the control piston 216 in the direction toward the valve seat 224.

As the above description of the construction of the column 12 shows, the column foot 14 and the column head 16 are not connected with one another through hydraulic lines. The equipment needed to feed the motor 128 of the hydraulic unit 24 can therefore be placed in the column foot 14 with such equipment being connected to the motor 168 through an electric cable 232. For example, batteries 234 may be arranged in the column foot which batteries permit an operation of the operating table not dependent on connection to electric supply mains. Further, the column foot 14 can contain a non-illustrated battery charging device and possibly a non-illustrated circuit device which permits drive of the motor 168 directly through the circuit at the same time as the battery 234 is charged. Finally, the column foot 14 has a cable reel 236 built into it for a cable 238 connectable to an electric mains.

We claim:

1. An operating table including a support surface with several support surface sections adjustable relative to one another by means of hydraulic cylinders, a support column for the support surface with a column head on which the support surface is pivotally supported and adjustable by means of hydraulic cylinders for movement about its longitudinal axis and/or its transverse axis, said support column also having a column foot, an hydraulic lifting apparatus connected between said column foot and said column head for raising and lowering said column head relative to said column foot, and a single hydraulic unit for operating both said cylinders and said lifting apparatus, said hydraulic unit including a hydraulic pump, a pump motor, and a pressure fluid tank, and said hydraulic unit being fixed to said column head for raising and lowering movement therewith relative to said column foot.

2. An operating table according to claim 1 further characterized in that the lift apparatus includes two anti-parallel lifting cylinders arranged next to one another and having equal internal cross sections, one of said cylinders having its piston rod connected with the column head and the other of said cylinders having its piston rod connected with the column foot with the two cylinders being connected in parallel.

3. An operating table according to claim 2 further characterized in that the pressure fluid flow to and from the lifting cylinders takes place through the piston rod connected to the column head.

4. An operating table including a support surface with several support surface sections adjustable relative to one another by means of hydraulic cylinders, a support column for the support surface with a column head on which the support surface is pivotally supported and adjustable by means of hydraulic cylinders for movement about its longitudinal axis and/or its transverse axis, and with a column foot connected with the column head through a hydraulic lifting apparatus, and a hydraulic unit for operating the cylinders and the lifting apparatus with a hydraulic pump, a pump motor, and a pressure fluid tank, said hydraulic unit being arranged on the column head, said lifting cylinders being clamped between two blocks connected by tie rods in which blocks connecting passages are formed for connecting the two work cylinders to the pressure fluid, with the piston sided ends of the two lift cylinders on one hand, and the piston rod sided ends of the lifting cylinders, on the other hand, being connected to one another through a pressure fluid conductor connecting together the two blocks.

5. An operating table including a support surface with several support surface sections adjustable relative to one another by means of hydraulic cylinders, a support column for the support surface with a column head on which the support surface is pivotally supported and adjustable by means of hydraulic cylinders for movement about its longitudinal axis and/or its transverse axis, and with a column foot connected with the column head through a hydraulic lifting apparatus, and a hydraulic unit for operating the cylinders and the lifting apparatus with a hydraulic pump, a pump motor, and a pressure fluid tank, said hydraulic unit being arranged on the column head, said lift apparatus including two antiparallel lifting cylinders arranged next to one another and having equal internal cross sections, one of said cylinders having its piston rod connected with the column head and the other of said cylinders having its piston rod connected with the column foot with the two cylinders being connected in parallel, said column having a guide apparatus including a first vertical guide rod connected with the column head and a second vertical guide rod arranged parallel to the first guide rod connected to the column foot, each of which guide rods is slidable in a respective one of two guides arranged parallel to one another and formed in a guide block and each of which guide rods is nonrotatably guided relative to the guide block, said guide block being coupled with the lifting cylinders for movement in a vertical direction.

6. An operating table according to claim 5 characterized in that the guide rods have a rectangular cross section and in that the guide block has a U-profile with a rectangular cross section, the U-profile being divided by a separating wall parallel to the arms of the U into two guide chambers for the guide rods, and that the block is closed by a cover plate extending parallel to the base of the U.

7. An operating table according to claim 6 further characterized in that on both of its sides the separating wall has wedge surfaces, which cooperate with wedges adjustable parallel to the separating wall for adjusting the play of the rods.

8. An operating table including a support surface with several support surface sections adjustable relative to one another by means of hydraulic cylinders, a support column for the support surface with a column head on which the support surface is pivotally supported and adjustable by means of hydraulic cylinders for movement about its longitudinal axis and/or its transverse axis, and with a column foot connected with the column head through a hydraulic lifting apparatus, and a hydraulic unit for operating the cylinders and the lifting apparatus with a hydraulic pump, a pump motor, and a pressure fluid tank, said hydraulic unit being arranged on the column head, said lifting apparatus including two lifting cylinders, a plurality of other work cylinders for positioning other parts of said operating table relative to one another, and said hydraulic unit having a high pressure circuit for actuating the work cylinders and the lifting cylinders and a low pressure circuit for controlling valves connecting the work cylinders and the lifting cylinders with the hydraulic pump or with the pressure fluid tank.

9. An operating table according to claim 8 further characterized in that the low pressure circuit includes a plurality of flexible control conductors which connect hydraulic operating elements of the valves with control valves assembled with one another in a portable hand register.

10. An operating table according to claim 9 further characterized in that the control valves each include a control piston slidable in a bore of a valve housing closed by a flexible membrane and which piston is movable from a closed position against a biasing force to an open position, and in that in the open position the effective piston surface exposed to the control pressure is larger than the piston surface exposed to the control pressure in the closed position of the piston with the surface difference being so chosen that the force resulting from the control pressure being such that the hydraulic force effective on the piston in the open position is smaller than the biasing force.

11. An operating table according to claim 1 wherein a middle section of the support surface is connected to the column head through a linkage enabling a pivotal movement of the middle section about a horizontal axis parallel to the longitudinal direction of the support surface and about an axis transverse to the support longitudinal direction and parallel to the support surface, and wherein each support surface section has two side rails, which are pivotally connected to the side rails of a neighboring support surface section for movement about pivot axes transverse to the support surface longitudinal direction and which pivotally connected side rails are adjustable relative to one another about said pivot axes by means of double acting work cylinders, the side rails of each support surface section being mechanically independent of one another and in the associated cylinders of the two side rails of each support surface section being so connected in series with one another that the annular space surrounding the piston rod of one work cylinder is connected to the piston sided cylinder space of the other work cylinder with the cross sectional area of the annular space of said one work cylinder and the cross sectional area of the piston sided cylinder space of said other work cylinder being identical.

12. An operating table including a support surface with several support surface sections adjustable relative to one another by means of hydraulic cylinders, a support column for the support surface with a column head on which the support surface is pivotally supported and adjustable by means of hydraulic cylinders for movement about its longitudinal axis and/or its transverse axis, and with a column foot connected with the column head through a hydraulic lifting apparatus, and a hydraulic unit for operating the cylinders and the lifting apparatus with a hydraulic pump, a pump motor, and a pressure fluid tank, characterized in that the hydraulic unit is arranged on the column head, a middle section of the support surface being connected to the column head through a linkage enabling a pivotal movement of the middle section about a horizontal axis parallel to the longitudinal direction of the support surface and about an axis transverse to the support longitudinal direction and parallel to the support surface, each support surface section having two side rails, which are pivotally connected to the side rails of a neighboring support surface section for movement about pivot axes transverse to the support longitudinal direction and which pivotally connected side rails are adjusted relative to one another about said pivot axes by means of double acting work cylinders, the side rails of each support surface section being mechanically independent of one another and the two associated cylinders of the two side rails of each support surface section being so connected by a conductor in series with one another that the annular space surrounding the piston rod of one work cylinder is connected to the piston sided cylinder space of the other work cylinder, the cross sectional area of the annular space of said one work cylinder and the cross sectional area of the piston sided cylinder space of said other work cylinder being identical, and said conductor connecting the annular space of said one work cylinder with the piston sided cylinder space of the other work cylinder having arranged in it a bleed valve.

13. An operating table according to claim 12 further characterized in that the bleed valve has a bleed port which is connected to the pressure fluid tank through a pressure limiting valve with the limit pressure set by the pressure limiting valve being smaller than the work pressure of the hydraulic unit.

14. An operating table according to claim 13 further characterized in that the bleed port of the bleed valve is connected with the high pressure circuit through a pressure regulating valve, with the regulated pressure set by the pressure regulating valve being smaller than the limit pressure set by the pressure limiting valve.

15. An operating table including a support surface with several support surface sections adjustable relative to one another by means of hydraulic cylinders, a support column for the support surface with a column head on which the support surface is pivotally supported and adjustable by means of hydraulic cylinders for movement about its longitudinal axis and/or its transverse axis, and with a column foot connected with the column head through a hydraulic lifting apparatus, and a hydraulic unit for operating the cylinders and the lifting apparatus with a hydraulic pump, a pump motor, and a pressure fluid tank, said hydraulic unit being arranged on the column head, a middle section of the support surface being connected to the column head through a linkage enabling a pivotal movement of the middle section about a horizontal axis parallel to the longitudinal direction of the support surface and about an axis transverse to the support longitudinal direction and parallel to the support surface, each support surface section having two side rails which are pivotally connected to the side rails of a neighboring support surface section for movement about pivot axes transverse to the support surface longitudinal direction and which pivotally connected side rails are adjustable relative to one another about said pivot axes by means of double acting work cylinders, the side rails of each support surface section being mechanically independent of one another and the two associated cylinders of the two side rails of each support surface section being so connected in series with one another that the annular space surrounding the piston rod of one work cylinder is connected to the piston sided cylinder space of the other work cylinder, the cross sectional area of the annular space of said one work cylinder and the cross sectional area of the piston sided cylinder space of said work cylinder being identical, and one support cushion connected with the side rails of each support surface section, said support cushion including a rigid plate which plate is releasably connectable with the associated side rails through releasable snap means.

16. An operating table according to claim 15 further characterized in that said support cushion is made of foam and in that said plate is embedded in the foam of the cushion.

* * * * *